US009303821B2

(12) United States Patent
Lin et al.

(10) Patent No.: US 9,303,821 B2
(45) Date of Patent: Apr. 5, 2016

(54) AIR-COOLED LED LAMP BULB

(71) Applicant: UniLED Lighting TW., Inc., New Taipei (TW)

(72) Inventors: Ming-Te Lin, New Taipei (TW); Ming-Yao Lin, New Taipei (TW); Heng Qiu, Kaohsiung (TW)

(73) Assignee: UNILED LIGHTING TW., INC., New Taipei (TW)

( * ) Notice: Subject to any disclaimer, the term of this patent is extended or adjusted under 35 U.S.C. 154(b) by 339 days.

(21) Appl. No.: 13/919,486

(22) Filed: Jun. 17, 2013

(65) Prior Publication Data

US 2014/0293623 A1 Oct. 2, 2014

Related U.S. Application Data

(63) Continuation-in-part of application No. 13/853,647, filed on Mar. 29, 2013, now Pat. No. 9,068,732.

(51) Int. Cl.

| | |
|---|---|
| ***F21V 29/00*** | (2015.01) |
| ***F21K 99/00*** | (2010.01) |
| ***F21V 29/83*** | (2015.01) |
| *F21Y 101/02* | (2006.01) |

(52) U.S. Cl.

CPC . *F21K 9/13* (2013.01); *F21V 29/83* (2015.01); *F21Y 2101/02* (2013.01)

(58) Field of Classification Search

CPC ... F21V 29/002; F21V 29/004; F21V 29/503; F21V 29/70; F21Y 2111/001; F21Y 2111/004; F21Y 2111/0076

USPC ..... 362/650, 240, 249.02, 294, 373

See application file for complete search history.

(56) References Cited

U.S. PATENT DOCUMENTS

| | | | | |
|---|---|---|---|---|
| 7,670,029 | B1 * | 3/2010 | Luo et al. | 362/294 |
| 7,789,534 | B2 * | 9/2010 | Wang | 362/294 |
| 7,874,700 | B2 * | 1/2011 | Patrick | 362/294 |
| 7,950,829 | B2 * | 5/2011 | Chiu et al. | 362/294 |
| 8,414,160 | B2 * | 4/2013 | Sun et al. | 362/294 |
| 8,525,395 | B2 * | 9/2013 | Muessli | 362/294 |
| 8,608,341 | B2 * | 12/2013 | Boomgaarden et al. | 362/294 |
| 8,616,714 | B2 * | 12/2013 | Lee et al. | 362/294 |
| 8,648,379 | B2 * | 2/2014 | Kim et al. | 257/98 |
| 2004/0114367 | A1 * | 6/2004 | Li | 362/248 |
| 2008/0170396 | A1 * | 7/2008 | Yuan et al. | 362/244 |
| 2013/0240920 | A1 * | 9/2013 | Lin et al. | 257/89 |
| 2014/0268700 | A1 * | 9/2014 | Mumma et al. | 362/249.12 |

FOREIGN PATENT DOCUMENTS

| | | | |
|---|---|---|---|
| CN | 102644866 | A | 8/2012 |
| KR | 100965558 | B1 * | 6/2011 |
| WO | WO 2014127450 | A1 * | 8/2014 |

* cited by examiner

*Primary Examiner* — Ismael Negron

(74) *Attorney, Agent, or Firm* — Hauptman Ham, LLP

(57) ABSTRACT

An air-cooled lamp bulb includes a central tube and a circular light wall. The circular light wall is formed by a plurality of light units surrounding the central tube and emitting light beams in a direction away from the central tube. A top frame supports the circular light wall on top. A top opening is formed in the top frame. A bottom gap is formed between a bottom of the central tube and a bottom of the circular light wall. An air passage is formed between the central tube and the circular light wall. The air passage connects the top opening and the bottom gap for allowing air flow through the air-cooled lamp bulb.

13 Claims, 18 Drawing Sheets

AIR-COOLED LED LAMP BULB

This application is a continuation-in-part application of U.S. application Ser. No. 13/853,647 filed Mar. 29, 2013, the disclosure of which is incorporated by reference herein in its entirety.

BACKGROUND

1. Technical Field

The present invention relates to a lamp, especially an air cooling LED lamp which has air passages for natural cooling the lamp without using an electric fan.

2. Description of Related Art

FIG. 1 is a prior art

FIG. 1 shows a prior art, it discloses an LED lamp with an electric fan for cooling the lamp. The LED 5 is mounted on a support 4. Cooling air 8 is guided through openings 11 in the lamp base 2 to electric fan 6 and blown out through a cavity 12 of the support 4 upward as discharge stream 9. Cooling fins 13 for reinforced cooling of the support 4 are arranged in cavity 12. By cooling the support 4, the power demand of the LED lamp can be increased.

The deficiency of the prior art is to use an electric fan 6 for the cooling. Running of the electric fan 6 consumes electric energy. It is desired to develop a natural cooling system without using an electric fan so as to reduce electricity consumption.

DETAILED DESCRIPTION OF THE INVENTION

This invention uses air passages for cooling the led lamp without using any electric fan so that the present invention is a green product which reduces electric energy consumption.

Figure 1:
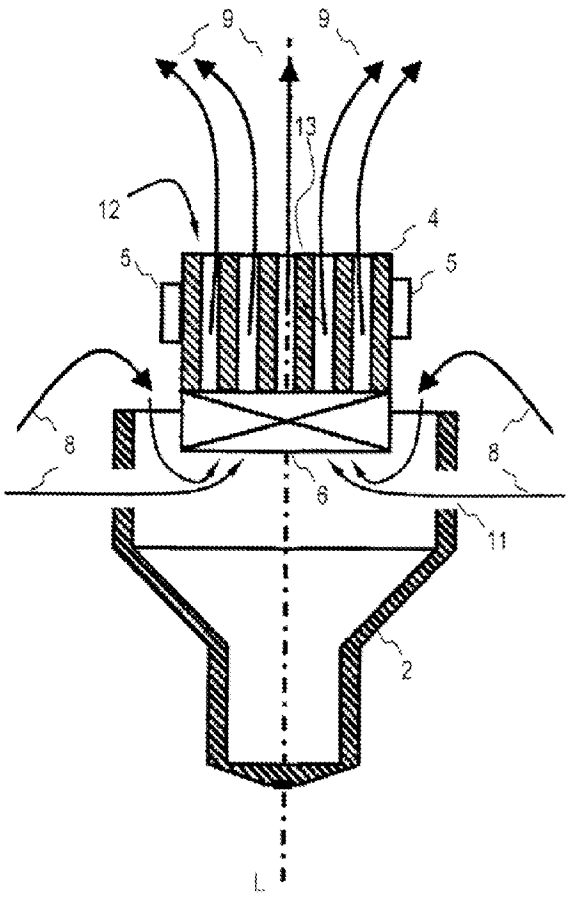
Fig.1 Prior Art
FIG. 1 is a prior art
Figure 2:
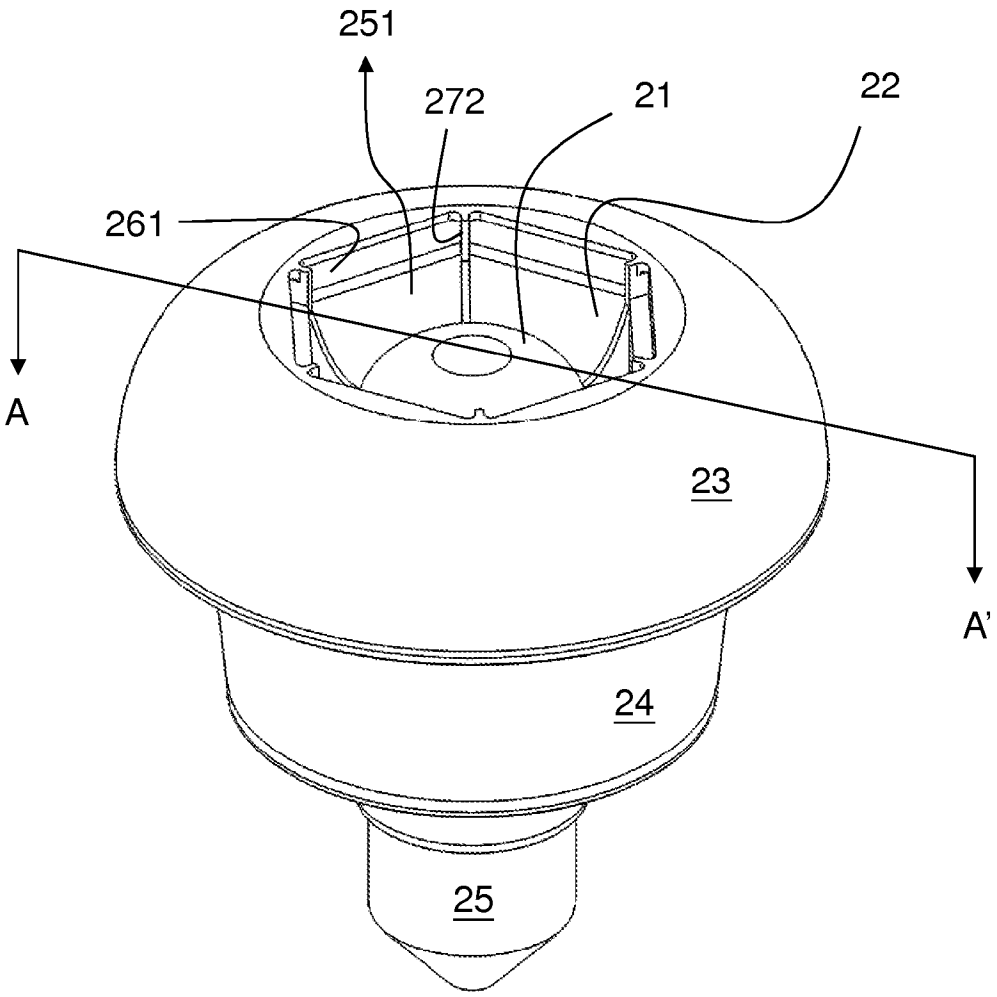
FIG. 2 is a first embodiment according to the present invention

FIG. 2 is a first embodiment according to the present invention

FIG. 2 shows an LED lamp, which has a central tube 21 for housing circuit board and other electronic elements. A circular light wall 22 encloses the central tube 21. An air passage 251 is formed between the central tube 21 and the light wall 22 for a natural air-flow bottom up. A lamp base 25 is configured on a bottom of the central tube 21 for being able to mount the lamp to a conventional lamp socket. A top gap 261 is configured on a top of the light wall 22 for air flow. Top rib 272 is used for fixing the position between the light wall and the transparent dome 23. A trumpet cup 24 is configured under the transparent dome 23.

Figure 3A:
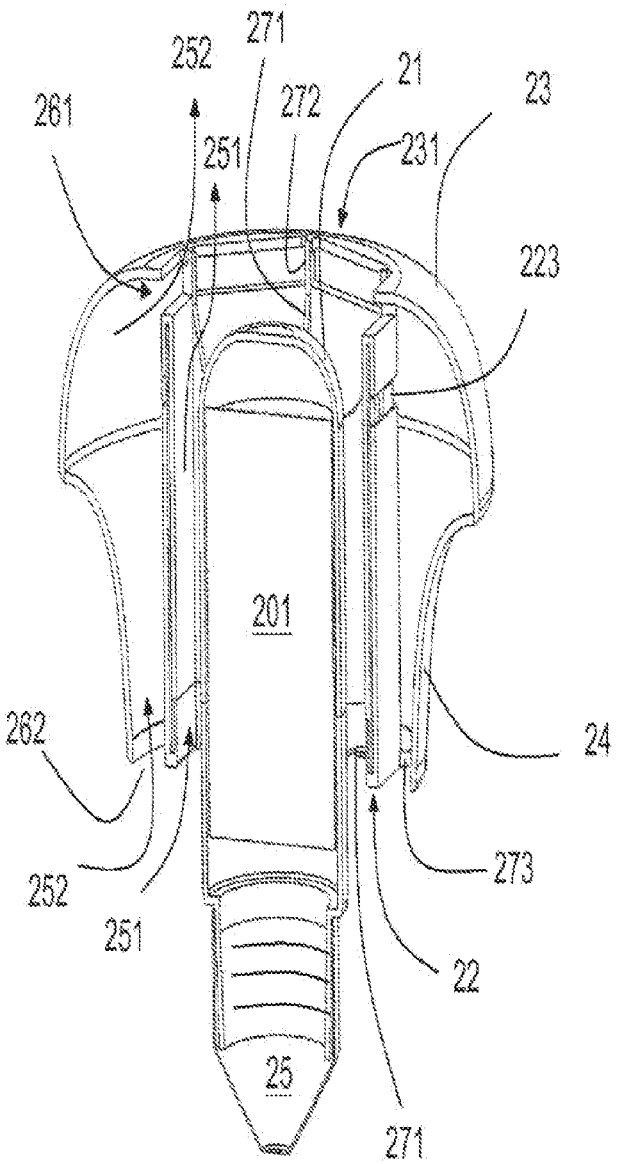
FIG. 3A is a section view of FIG. 2

FIG. 3A is a section view of FIG. 2

FIG. 3A is a section view of the lamp according to line AA' shown in FIG. 2. The section view shows a central tube 21 having circuit board 201 and other electronic elements (not shown) inside. A circular light wall 22 is composed of a plurality of light unit 221 that are configured side by side. The circular light wall 22 surrounds the central tube 21. Each of the light units 221 has a light source 223 mounted on a top end facing outward. A transparent dome 23 surrounds a top of the circular light wall 22 for modifying light beams of the light unit 221 before emitting. A central cavity 231 is configured on a top center of the transparent dome 23.

A first air passage 251 is formed between the central tube 21 and the circular light wall 22 for air flow. A trumpet cup 24 is configured under the transparent dome 23, surrounds lower part of the circular light wall 22. A top gap 261 is configured between a top end of the transparent dome 23 and a top end of the circular light wall 22. The top gap 261 communicates with the central cavity 231. A bottom gap 262 is configured between a bottom of the circular light wall 22 and a bottom of the trumpet cup 24. A second air passage 252 communicates between the top gap 261 and the bottom gap 262 for air flow.

An inner rib 271 is configured between the central tube 21 and the circular light wall 22 for fixing a position between the central tube 21 with reference to the circular light wall 22. An outer rib 273 is configured between the circular light wall 22 and a trumpet cup 24 for fixing a position between the circular light wall 22 and the trumpet cup 24. A top rib 272 is configured between a top end of the circular light wall 22 and a top end of the transparent dome 23 for fixing a position between the circular light wall 22 and the transparent dome 23.

Figures 3B, 3C:
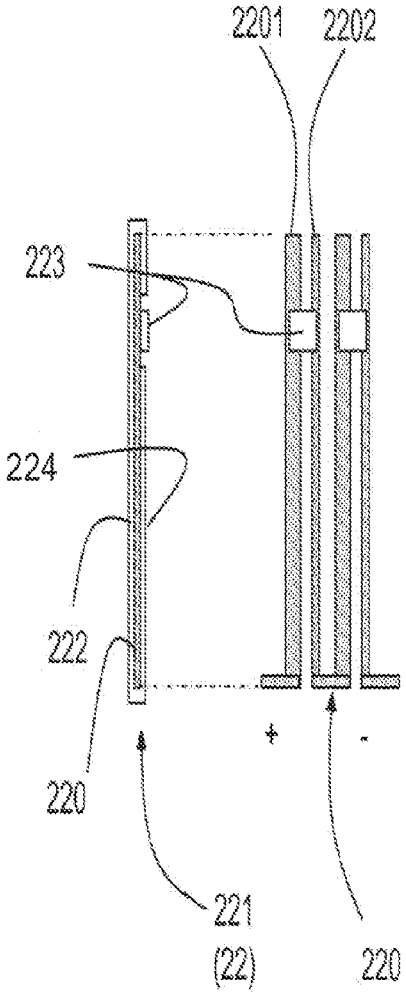
FIG. 3B is a side view of the light unit of FIG. 3A
FIG. 3C is a front view of the metal strip of FIG. 3B

FIG. 3B is a side view of the light unit of FIG. 3A. FIG. 3B shows that the light source 223, which includes an LED, is mounted on a top of the metal strip 220. A front side protection layer 224 coated on a front side of the metal strip 220 except an area for the light source 223 to mount. A back side protection layer 222 is coated on a back side of the metal strip 220.

FIG. 3C is a front view of the metal strip of FIG. 3B

FIG. 3C shows the structure of a metal strip 220 of the light unit 221. A pair of metal strips 2201, 2202 is parallel configured. The light source 223 is straddled on a top of the metal strips 2201, 2202.

Figure 4:
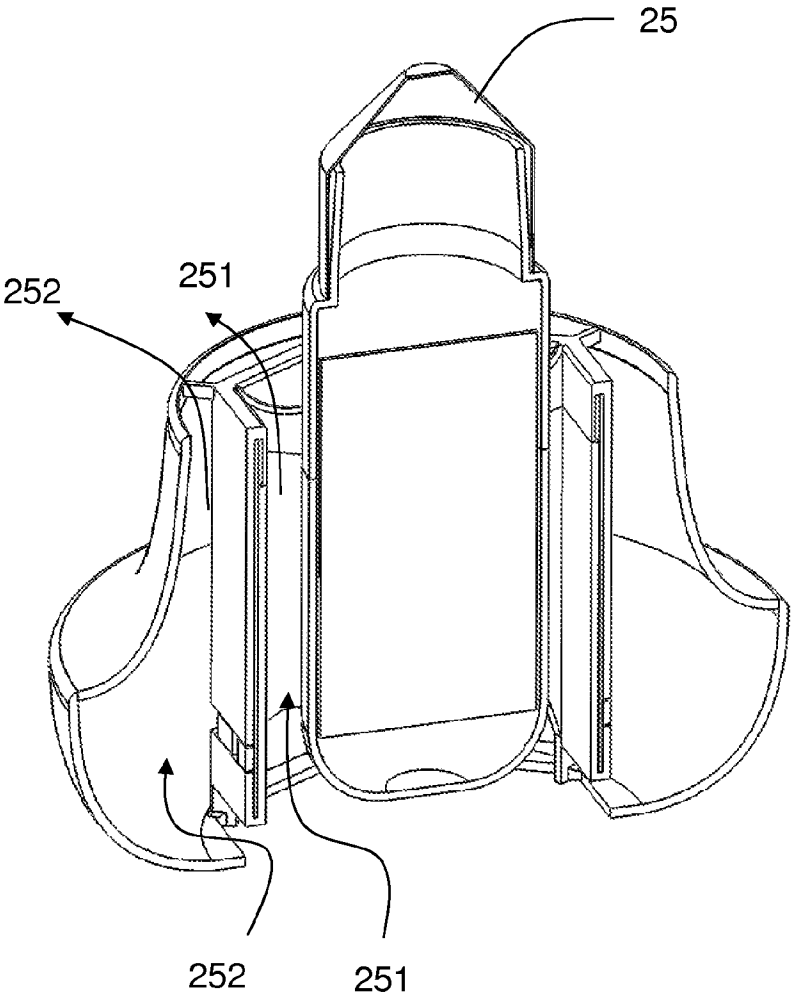
FIG. 4 is a reversed position of the lamp of FIG. 3A

FIG. 4 is a reversed position of the lamp of FIG. 3A

FIG. 4 shows when the lamp of FIG. 3A is configured in a reversed position, the first air passage 251 and the second air passage 252 still work for the air flow cooling bottom up.

Figure 5:
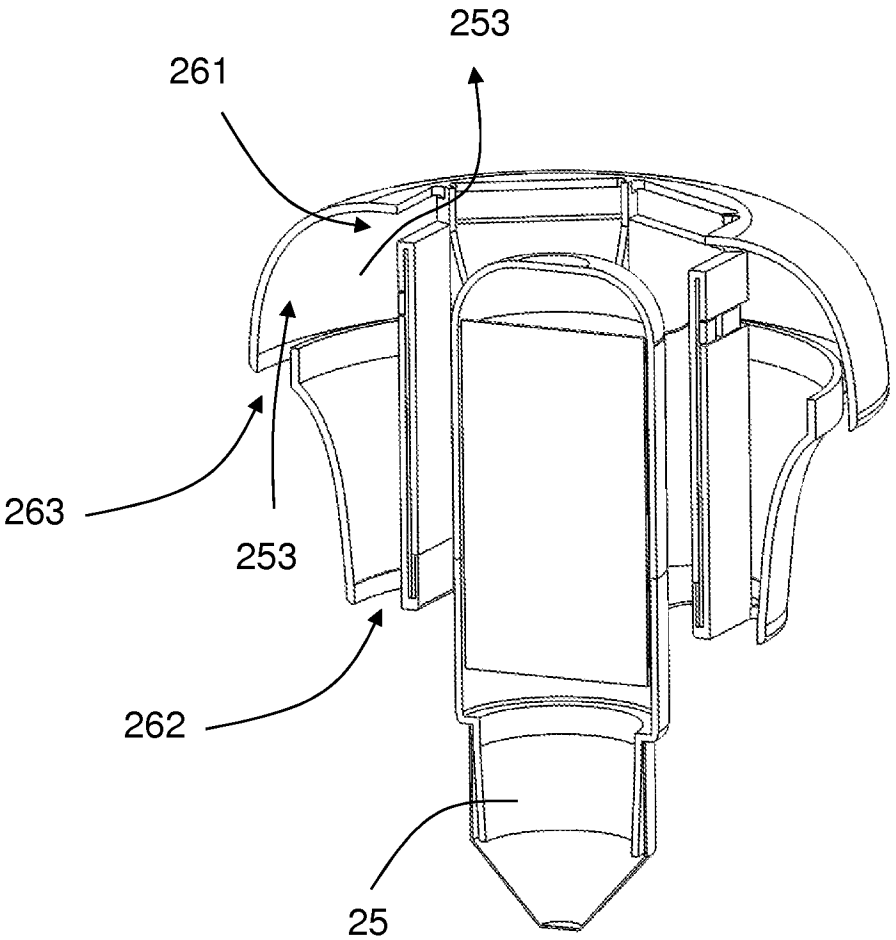
FIG. 5 is a second embodiment according to the present invention

FIG. 5 is a second embodiment according to the present invention

FIG. 5 is a modified lamp of FIG. 3A. FIG. 5 shows that a side gap 263 is configured between a bottom end of the transparent dome 23 and a top end of the trumpet cup 24. A third air passage 253 communicates between the side gap 263 with the top gap 261 for air flow.

Figure 6:
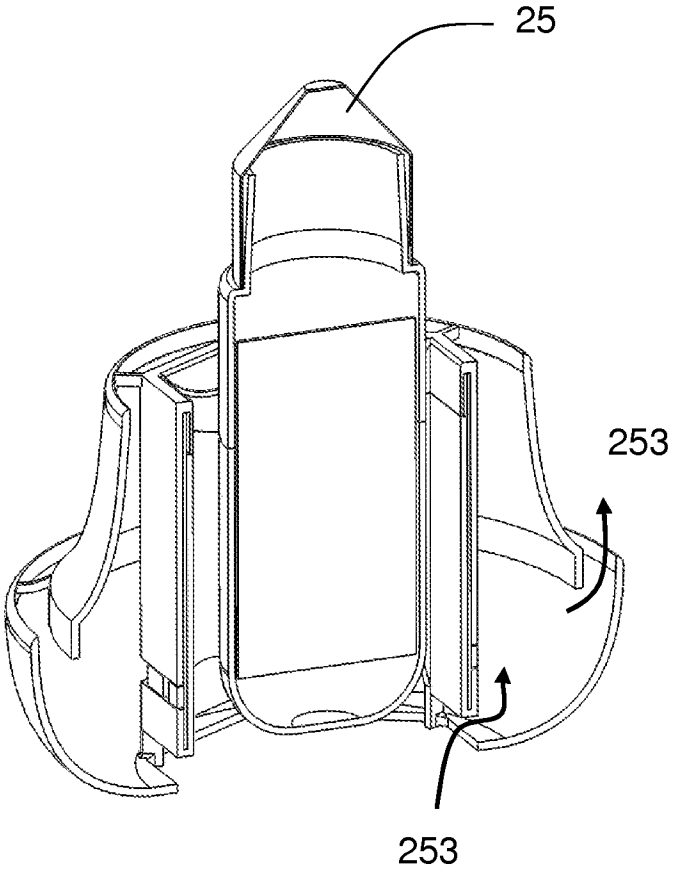
FIG. 6 is a reversed position of the lamp of FIG. 5

FIG. 6 is a reversed position of the lamp of FIG. 5

FIG. 6 shows when the lamp of FIG. 5 is configured in a reversed position, the third air passage 253 still work for the air flow bottom up.

Figure 7:
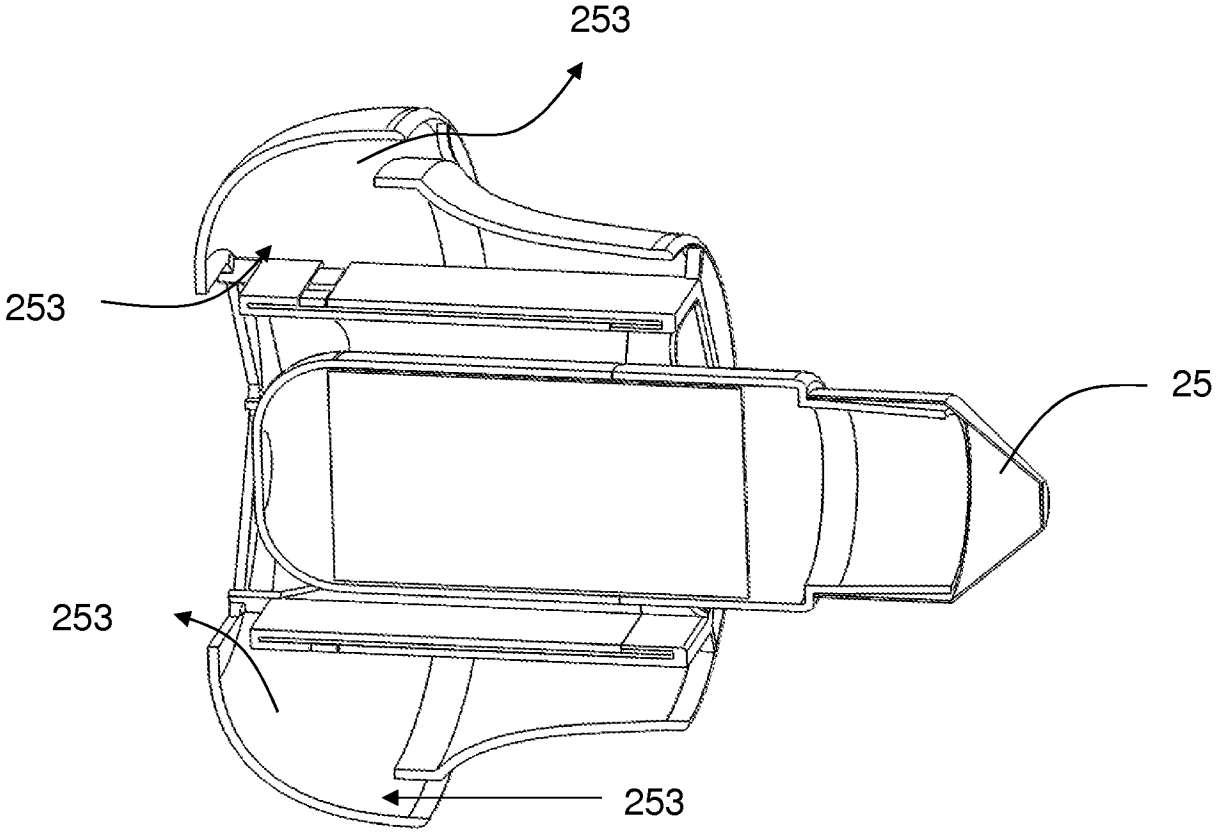
FIG. 7 is a lateral position of the lamp of FIG. 5

FIG. 7 is a lateral position of the lamp of FIG. 5

FIG. 7 shows when the lamp of FIG. 5 is configured in a lateral position, the third air passage 253 still work for the air flow bottom up.

Figure 8:
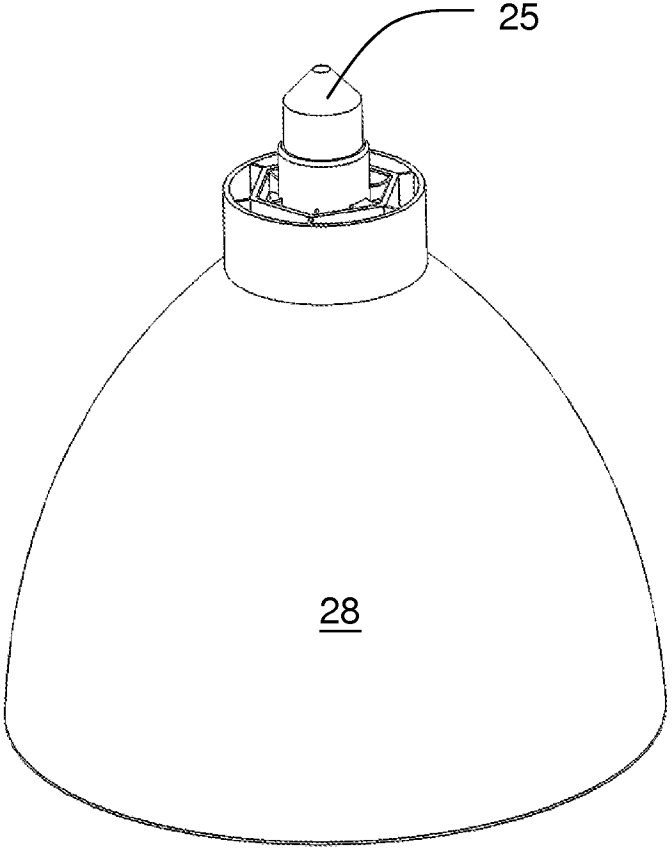
FIG. 8 is a modified embodiment according to the present invention

FIG. 8 is a modified embodiment according to the present invention

FIG. 8 shows that a reflection cup 28 is prepared to cover the lamp as a lampshade for modifying the light direction of the light source 223 before emitting.

Figure 9:
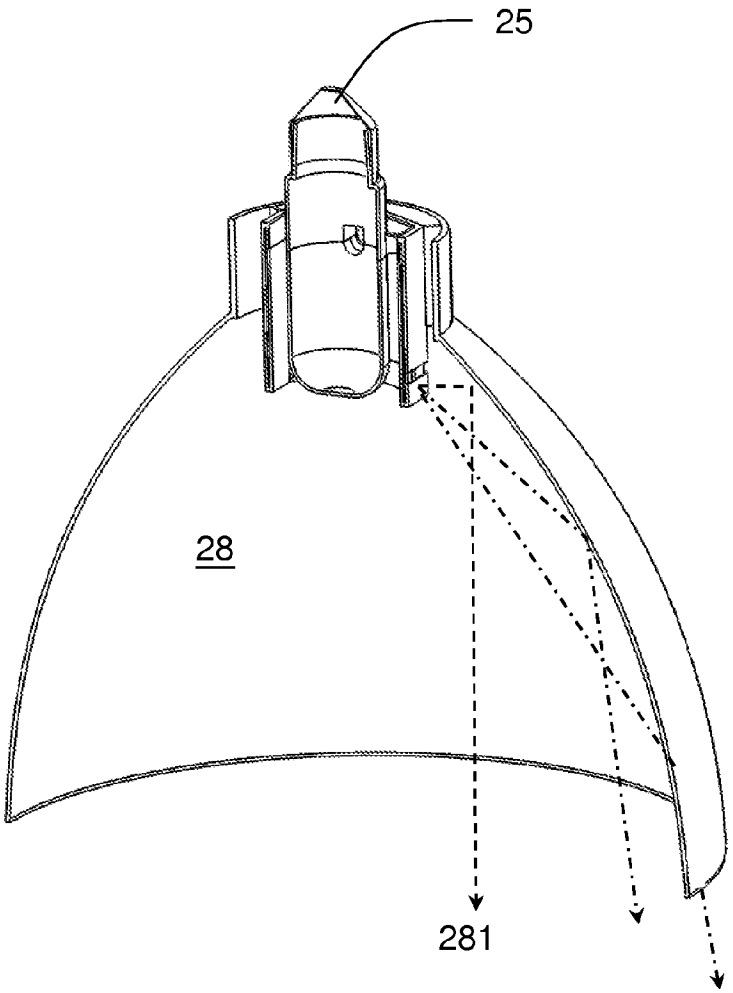
FIG. 9 is a section view of FIG. 8

FIG. 9 is a section view of FIG. 8

FIG. 9 shows the direction of the light beams 281 have been modified by the inner wall of the reflection cup 28 before the light beams exiting the lamp.

Figure 10:
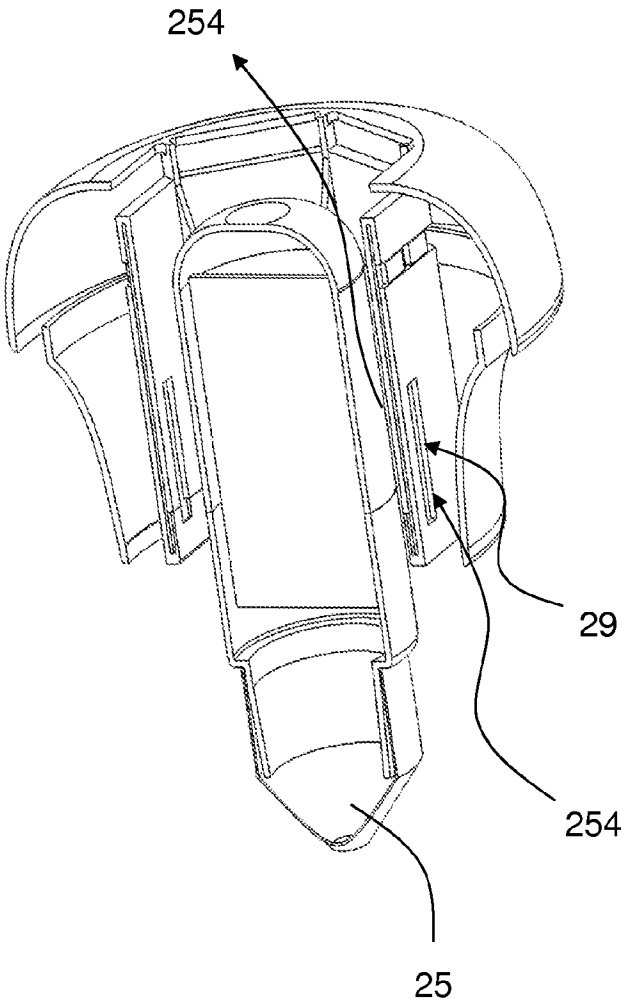
FIG. 10 is a modified lamp of FIG. 3A

FIG. 10 is a modified lamp of FIG. 3A

FIG. 10 shows that a slot 29 is configured passing through a lower portion of the light unit. A further air passage 254 is formed for air flow to enhance the cooling efficiency.

Figure 11:
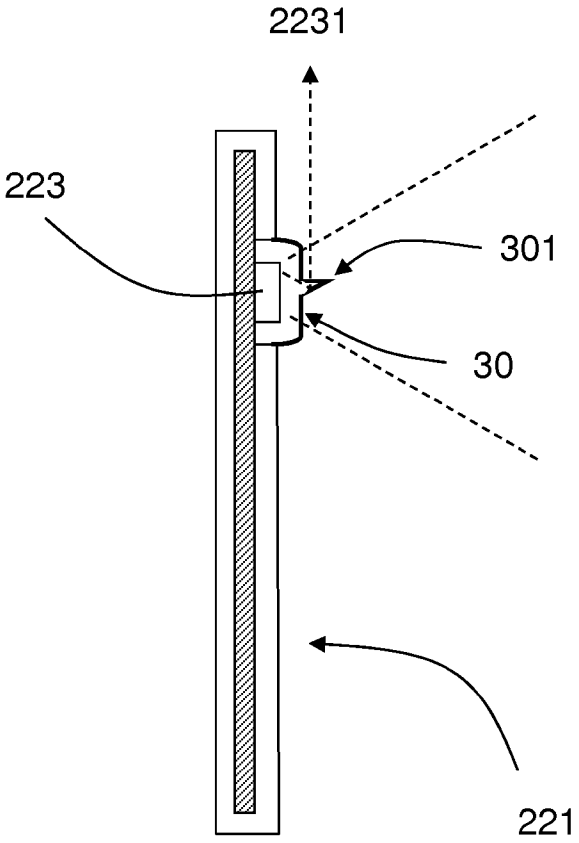
FIG. 11 is a modified light unit of FIG. 3B

FIG. 11 is a modified light unit of FIG. 3B

FIG. 11 shows that a lens 30 is configured in front of the light source 223 of the light unit 221 for compensating the light beams upward 2231. The lens 30 has a triangle extension 301 for reflecting light beam upward.

Figure 12:
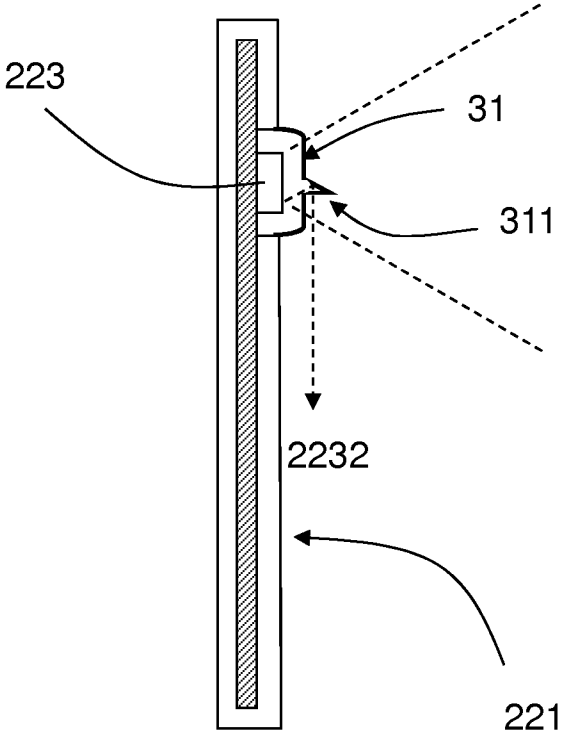
FIG. 12 is a further modified light unit of FIG. 3B

FIG. 12 is a further modified light unit of FIG. 3B

FIG. 12 shows that a lens 31 is configured in front of the light source 223 of the light unit 221 for compensating the light beams downward 2232. The lens has a triangle extension 311 for reflecting light beam downward.

Figure 13:
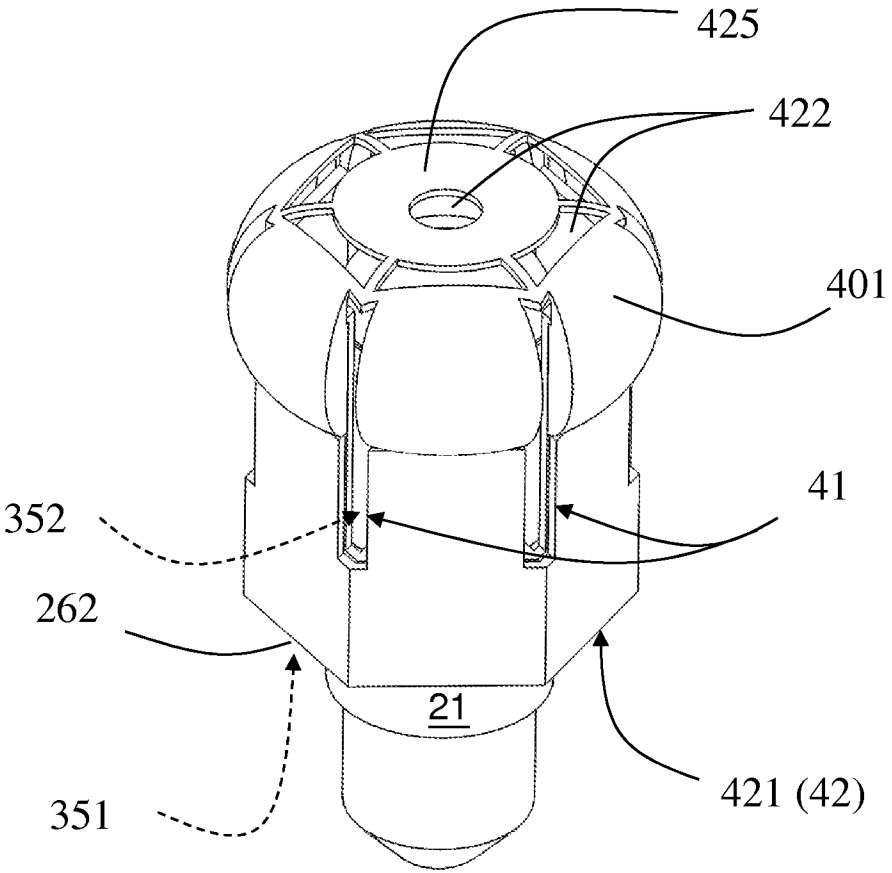
FIG. 13 is a third embodiment according to the presentation invention.

FIG. 13 is a third embodiment according to the presentation invention.

FIG. 13 shows that an air cooling LED lamp has a central tube 21 surrounded by a circular light wall 42. A top frame 425 connects the circular light wall 42 on top. A plurality of top opening 422 is made in the top frame 425 as an air outlet. A plurality bottom gap 262 is configured between a bottom of the central tube 21 and a bottom of the circular light wall 42. A first air passage 351 is configured between the central tube 21 and the circular light wall 42. The first air passage 351 communicates the top opening 422 and the bottom gap 262. The bottom gap 262 functions as a first air inlet. A plurality of side opening 41 is configured passing through the circular light wall 42. Each of the side opening 41 functions as a second air inlet. The opening 41 communicates with the first air passage 351. A second air passage 352 is formed between the side opening 41 and the top opening 422 for air flow. FIG. 13 shows that a six-facet polygon as an example, more or less number of light facet can be designed as the polygon light wall according to different application. The side opening 41 is made in a position between two neighboring light facets 421, in other words, the side opening 41 is made in the boundary or corner of neighboring light facet 421.

Figure 14:
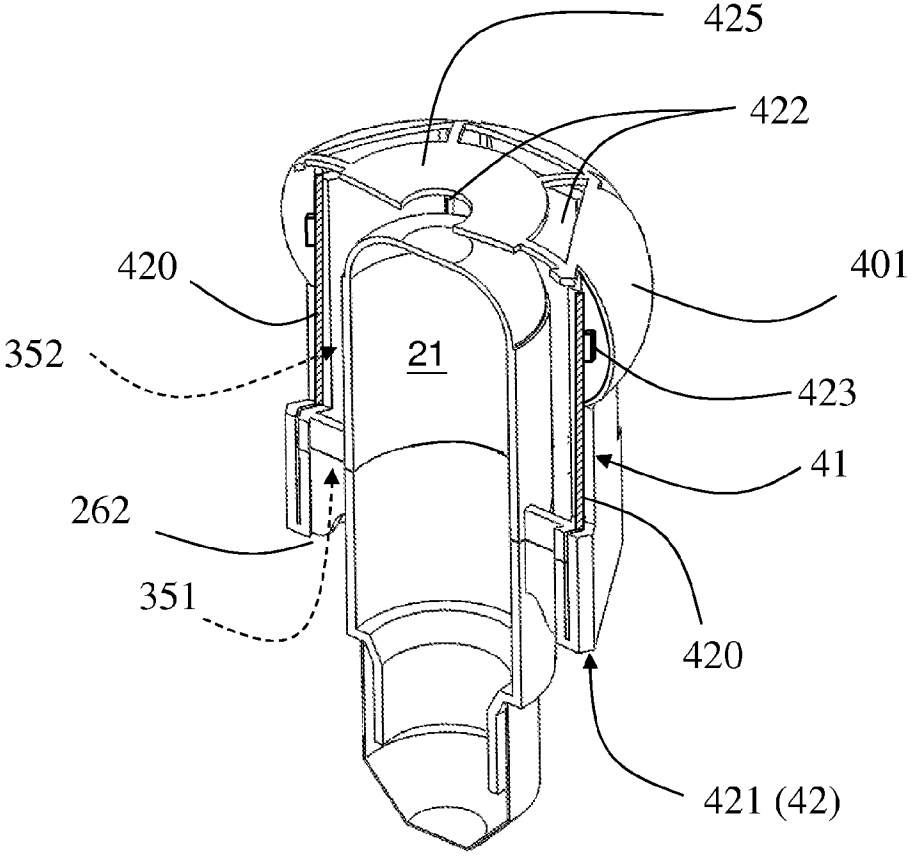
FIG. 14 is a section view of FIG. 13

FIG. 14 is a section view of FIG. 13

FIG. 14 shows that a metal strip 420 is partially sandwiched by protection layers in each light facet 421. An LED chip 423 is mounted on a top of the metal strip 420 to emit light beams facing outward to illuminate peripheral surrounding. A plurality of side opening 41 is made passing through the light wall 42. The side opening 41 is configured in a boundary or corner of neighboring light facets 421 of the polygon light wall 42. FIG. 14 shows that a side opening 41 is made beside the metal strip 420 in a section view. The protection cover 401 is configured in front of the LED chip 423. The first air passage 351 is configured between the bottom gap 262 and the top opening 422. The second air passage 352 is configured between the side opening 41 and the top opening 422.

Figure 15B:
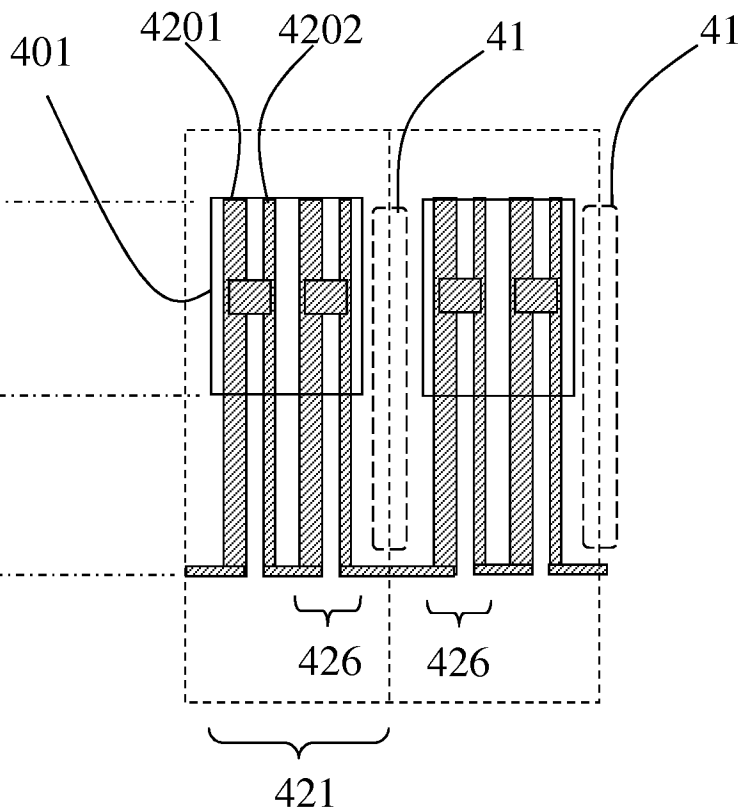
FIG. 15B is a front view of the light unit of FIG. 14
Figure 15A:
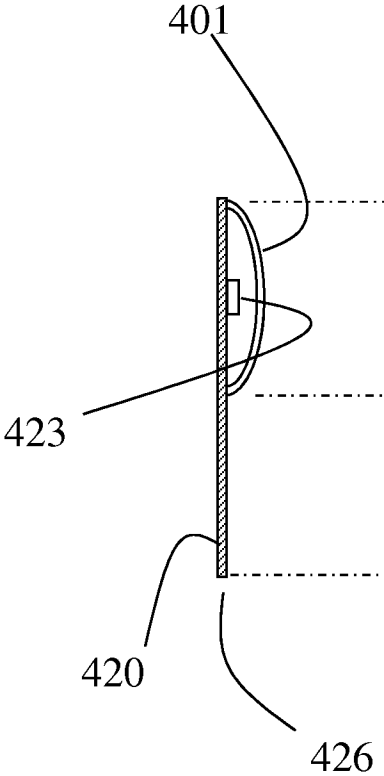
FIG. 15A is a side view of the light unit of FIG. 14

FIG. 15A is a side view of the light unit of FIG. 14

FIG. 15A shows that the light unit 426 has a LED chip 423 mounted on a top end of the metal strip 420, and a protection cover 401 is configured in front of the LED chip 423.

FIG. 15B is a front view of the light unit of FIG. 14

FIG. 15B shows that each light unit 426 has a pair of metal strips 4201, 4202. The LED chip 423 straddles on the two metal strips. The side opening 41 is made in a location between two neighboring light unit 426. Referring to FIG. 13 in view of FIG. 15B, each light facet 421 has two light units 426 inside; but this is an example only for describing the concept of the instant application; more or less light unit 426 can also be used in a single light facet 421.

Figure 16:
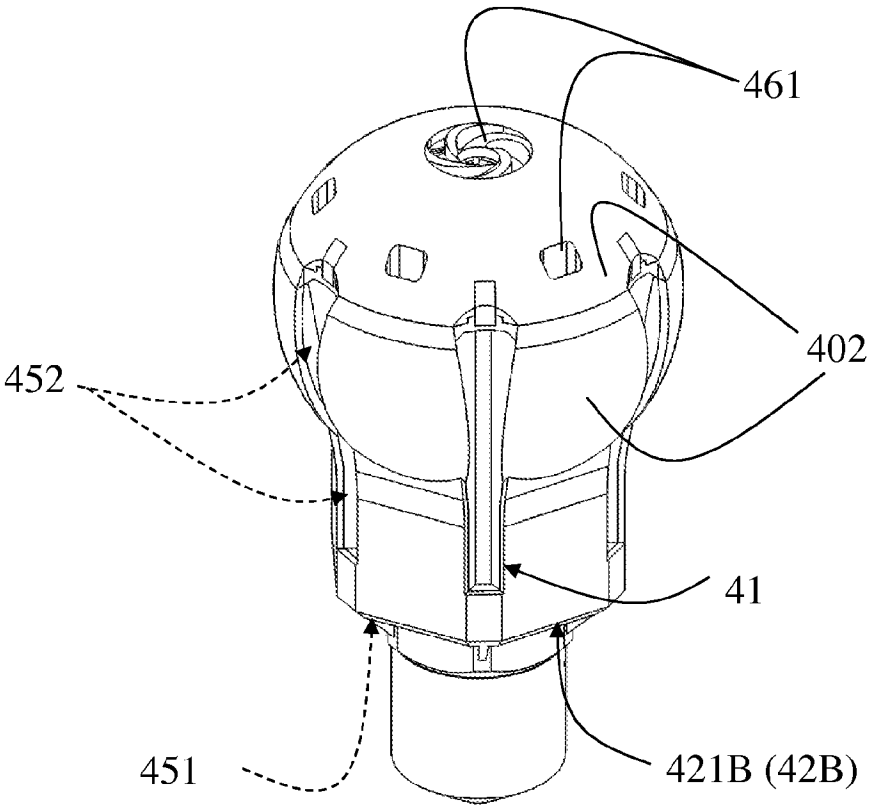
FIG. 16 is a fourth embodiment according to the presentation invention.

FIG. 16 is a fourth embodiment according to the presentation invention.

In comparison with FIG. 13, which shows a flat top frame 425 with a plurality of openings 422, the design of FIG. 16 shows a dome top protection cover 402 with a plurality of top openings 461.

Figure 17:
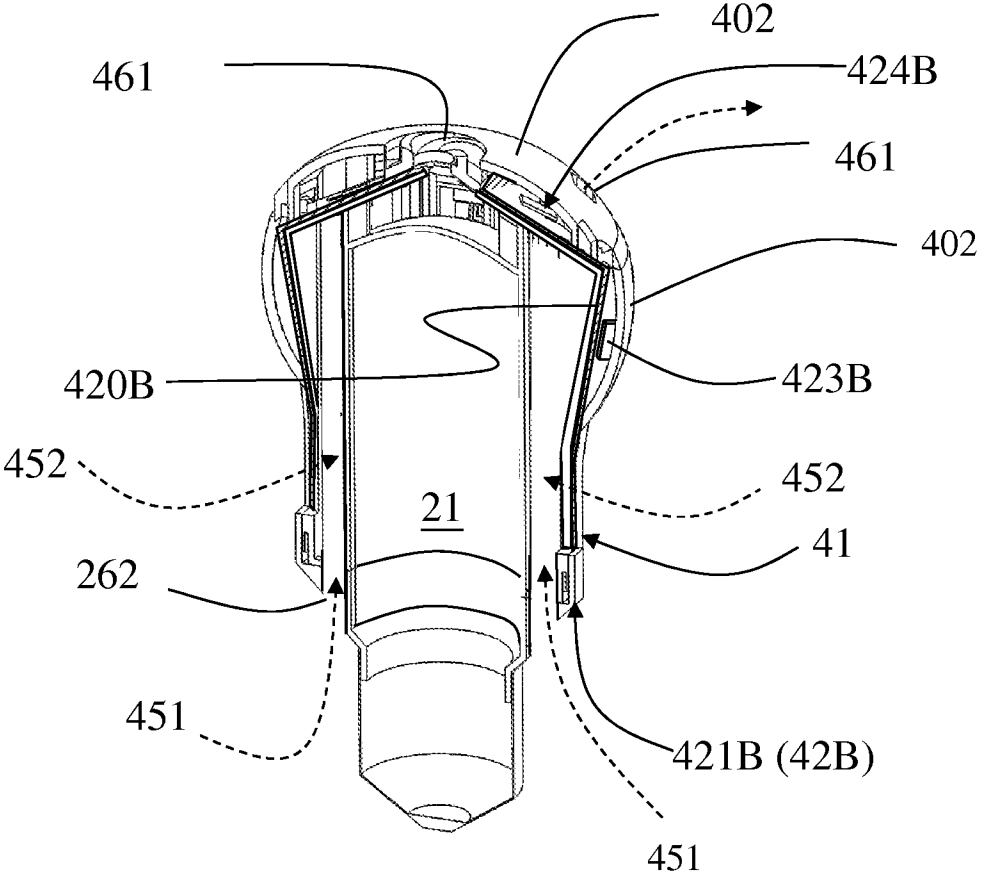
FIG. 17 is a section view of FIG. 16

FIG. 17 is a section view of FIG. 16

FIG. 17 shows that a curved metal strip 420B is partially sandwiched by protection layers in each light facet 421B. The curved metal strip 420B has a first facet facing peripheral oblique downward and a second facet facing peripheral oblique upward. A first LED chip 423B is mounted on the first facet in a position obliquely downward so as to emit light beams to illuminate obliquely downward. A second LED chip 424B is mounted on the second facet in a position obliquely upward so as to emit light beams to illuminate obliquely upward. The remaining structure is similar to the corresponding structure of the design of FIG. 13.

A first air passage 451 is configured between the central tube 21 and the circular light wall 42B. The first air passage 451 communicates the top opening 461 and the bottom gap 262. The bottom gap 262 functions as a first air inlet. A plurality of side opening 41 is configured passing through the circular light wall 42B. Each of the side opening 41 functions as a second air inlet. The opening 41 communicates with the first air passage 451. A second air passage 452 is formed between the side opening 41 and the top opening 461 for air flow.

Figure 18B:
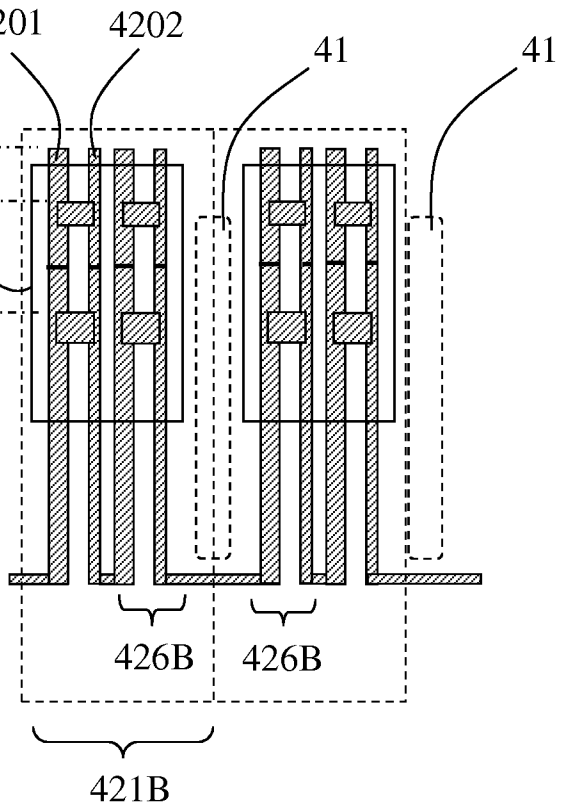
FIG. 18B is a front view of the light unit of FIG. 17
Figure 18A:
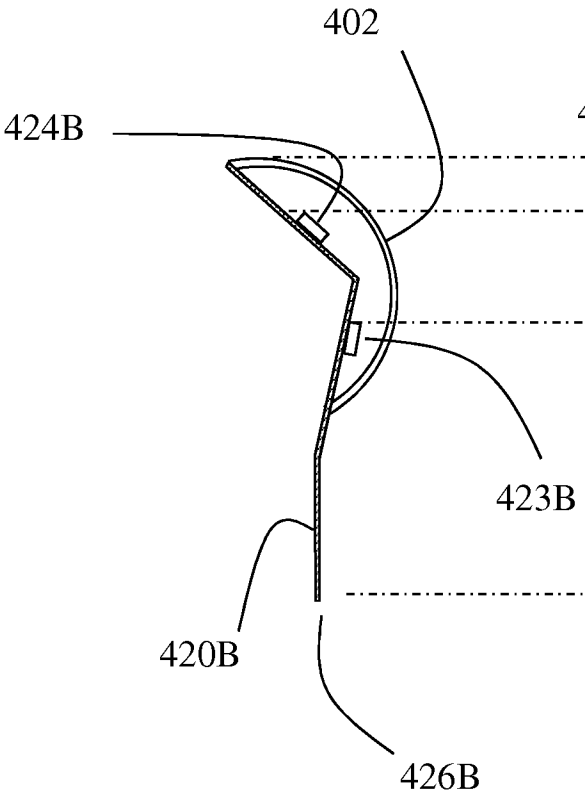
FIG. 18A is a side view of the light unit of FIG. 17

FIG. 18A is a side view of the light unit of FIG. 17

FIG. 18A shows that a first LED chip 423B is mounted on the first facet of the curved metal strip 420B, facing obliquely downward; and a second LED chip 424B is mounted on the second facet of the curved metal strip 420B, facing obliquely upward. A protection cover 402 is configured in front of both LED chips 423B and 424B.

FIG. 18B is a front view of the light unit of FIG. 17

FIG. 18B shows that each light unit 426B has a pair of metal strips 4201, 4202. Each of the first LED chip 423B and the second LED chip 424B, straddles on the two metal strips. The side opening 41 is made between two neighboring light unit 426B. Referring to FIG. 16 in viewing of FIG. 18B, each light facet 421 has two light units 426B inside; but this is an example only for describing the concept of the instant application; more or less light unit 426 can also be used in a single light facet 421.

While several embodiments have been described by way of example, it will be apparent to those skilled in the art that various modifications may be configured without departing from the spirit of the present invention. Such modifications are all within the scope of the present invention, as defined by the appended claims.

What is claimed is:

1. An air-cooled lamp bulb, comprising:

a central tube;

a circular light wall formed by a plurality of light units surrounding the central tube and emitting light beams in a direction away from the central tube;

a top frame supporting the circular light wall on top;

a top opening formed in the top frame;

a bottom gap formed between a bottom of the central tube and a bottom of the circular light wall; and a first air passage formed between the central tube and the circular light wall, and connecting the top opening and the bottom gap for allowing air flow through the air-cooled lamp bulb.

2. The air-cooled lamp bulb as claimed in claim 1, further comprising:

a side opening passing through the circular light wall; and a second air passage formed between the side opening and the top opening for allowing air flow through the air-cooled lamp bulb.

3. The air-cooled lamp bulb as claimed in claim 2, wherein the circular light wall comprises a plurality of polygon light facets, and the side opening is formed in a position between two facets among the plurality of polygon light facets.

4. The air-cooled lamp bulb as claimed in claim 2, wherein the circular light wall comprises a plurality of polygon light facets, and the side opening is configured in a boundary of neighboring facet among the plurality of polygon light facets.

5. The air-cooled lamp bulb as claimed in claim 2, wherein the circular light wall comprises a plurality of polygon light facets, and the side opening is configured in a corner of a facet among the plurality of polygon light facets.

6. An air-cooled lamp bulb, comprising:

a central tube;

a circular light wall formed by a curve light unit surrounding the central tube, the curved light unit having a first facet facing obliquely downward and a second facet facing obliquely upward;

a dome top protection cover;

a top opening formed on a top of the dome top protection cover;

a bottom gap formed between a bottom of the central tube and a bottom of the circular light wall; and a first air passage formed between the central tube and the circular light wall, and connecting the bottom gap and the top opening for allowing air flow through the air-cooled lamp bulb.

7. The air-cooled lamp bulb as claimed in claim 6, further comprising:

a side opening passing through the circular light wall; and a second air passage formed between the side opening and the top opening for allowing air flow through the air-cooled lamp bulb.

8. The air-cooled lamp bulb as claimed in claim 6, wherein the circular light wall comprises a plurality of polygon light facets, and the side opening is formed in a position between two facets among the plurality of polygon light facets.

9. The air-cooled lamp bulb as claimed in claim 6, wherein the circular light wall comprises a plurality of polygon light facets, and the side opening is configured in a boundary of neighboring facets among the plurality of polygon light facets.

10. The air-cooled lamp bulb as claimed in claim 6, wherein the circular light wall comprises a plurality of polygon light facets, and the side opening is configured in a corner of a facet among the plurality of polygon light facets.

11. The air-cooled lamp bulb as claimed in claim 6, further comprising:

a first LED chip mounted on the first facet and emitting a light beam obliquely downward.

12. The air-cooled lamp bulb as claimed in claim 11, further comprising:

a second LED chip mounted on the second facet and emitting a light beam obliquely upward.

13. The air-cooled lamp bulb as claimed in claim 12, further comprising:

a protection cover formed in front of the first LED chip and the second LED chip.

* * * * *